US012747906B2

(12) United States Patent
Inlek

(10) Patent No.: US 12,747,906 B2
(45) Date of Patent: Sep. 29, 2026

(54) TEMPERATURE STABILIZATION OF CRYOGENIC SETUPS WITH RADIATIVE LOAD

(71) Applicant: IonQ, Inc., College Park, MD (US)

(72) Inventor: Ismail Volkan Inlek, Kensington, MD (US)

(73) Assignee: IonQ, Inc., College Park, MD (US)

( * ) Notice: Subject to any disclaimer, the term of this patent is extended or adjusted under 35 U.S.C. 154(b) by 523 days.

(21) Appl. No.: 18/352,633

(22) Filed: Jul. 14, 2023

(65) Prior Publication Data

US 2026/0002724 A1 Jan. 1, 2026

Related U.S. Application Data

(60) Provisional application No. 63/392,292, filed on Jul. 26, 2022.

(51) Int. Cl.
*F25D 19/00* (2006.01)

(52) U.S. Cl.
CPC ..... *F25D 19/00* (2013.01)

(58) Field of Classification Search
CPC ..... F25D 19/00
See application file for complete search history.

(56) References Cited

U.S. PATENT DOCUMENTS 4,920,264 A * 4/1990 Becker ..... G01N 1/42 250/288
7,310,954 B2 * 12/2007 Miki ..... C01B 3/0089 62/51.1
8,910,486 B2 * 12/2014 Bin-Nun ..... F25B 9/14 62/51.2
9,234,691 B2 * 1/2016 Black ..... F25B 9/145
9,651,569 B1 * 5/2017 Putman ..... B64G 1/54
10,126,024 B1 * 11/2018 Chui ..... F25B 25/00
10,253,928 B2 * 4/2019 Simpkins ..... F25D 19/006
10,941,990 B2 * 3/2021 Raman ..... B60H 1/32
11,187,440 B2 * 11/2021 Wikus ..... G01R 33/3815
11,248,747 B2 * 2/2022 Gustafson ..... F17C 7/04
11,408,689 B2 * 8/2022 Raman ..... B60H 1/00328
11,815,287 B2 * 11/2023 Teitelbaum ..... F24F 11/70
11,867,446 B2 * 1/2024 Corey ..... F25D 16/00
11,879,847 B2 * 1/2024 Debnath ..... G06N 10/40
11,956,924 B1 * 4/2024 Doherty ..... H05K 7/2039
2008/0115510 A1 * 5/2008 Crowley ..... F25B 9/145 174/15.1
2010/0000232 A1 * 1/2010 Valentian ..... B64G 1/4021 62/50.3
2012/0252678 A1 * 10/2012 Kim ..... G01R 33/326 62/51.1
2014/0130520 A1 * 5/2014 Snow ..... F25D 19/00 62/6
2017/0211859 A1 * 7/2017 Blaauwgeers ..... F25B 9/10
2019/0277784 A1 * 9/2019 Stautner ..... G01N 35/00
2019/0348251 A1 * 11/2019 Monroe ..... H01J 37/08
(Continued)

*Primary Examiner* — Filip Zec

(74) *Attorney, Agent, or Firm* — ARENTFOX SCHIFF LLP

(57) ABSTRACT

Aspects of the present disclosure relate generally to systems and methods for use in the implementation and/or operation of quantum information processing (QIP) systems, and more particularly, to systems and methods for providing temperature stabilization of cryogenic setups with radiative load.

20 Claims, 9 Drawing Sheets

(56) References Cited

U.S. PATENT DOCUMENTS

| | | | | |
|---|---|---|---|---|
| 2020/0054961 | A1* | 2/2020 | Petroff | F25B 9/10 |
| 2020/0102216 | A1* | 4/2020 | Fiedler | B81B 7/0038 |
| 2020/0370792 | A1* | 11/2020 | Matthews | F25B 9/12 |
| 2020/0373475 | A1* | 11/2020 | Rufenacht | H10N 60/805 |
| 2021/0341233 | A1* | 11/2021 | Shin | B60H 1/32 |
| 2022/0319730 | A1* | 10/2022 | Johansen | G21K 1/003 |
| 2023/0090979 | A1* | 3/2023 | Matthews | F25B 9/145 220/560.04 |
| 2023/0160630 | A1* | 5/2023 | Kodama | H05B 3/0071 62/51.1 |
| 2024/0344743 | A1* | 10/2024 | Jiang | F25B 19/005 |

* cited by examiner

TEMPERATURE STABILIZATION OF CRYOGENIC SETUPS WITH RADIATIVE LOAD

CROSS-REFERENCE TO RELATED APPLICATION

This application claims the benefit of U.S. Provisional Patent Application No. 63/392,292, filed Jul. 26, 2022 and hereby incorporates by reference herein the contents of this application.

TECHNICAL FIELD

Aspects of the present disclosure relate generally to systems and methods for use in the implementation, operation, and/or use of quantum information processing (QIP) systems.

BACKGROUND

Trapped atoms are one of the leading implementations for quantum information processing or quantum computing. Atomic-based qubits may be used as quantum memories, as quantum gates in quantum computers and simulators, and may act as nodes for quantum communication networks. Qubits based on trapped atomic ions enjoy a rare combination of attributes. For example, qubits based on trapped atomic ions have very good coherence properties, may be prepared and measured with nearly 100% efficiency, and are readily entangled with each other by modulating their Coulomb interaction with suitable external control fields such as optical or microwave fields. These attributes make atomic-based qubits attractive for extended quantum operations such as quantum computations or quantum simulations.

It is therefore important to develop new techniques that improve the design, fabrication, implementation, control, and/or functionality of different QIP systems used as quantum computers or quantum simulators, and particularly for those QIP systems that handle operations based on atomic-based qubits.

SUMMARY

The following presents a simplified summary of one or more aspects to provide a basic understanding of such aspects. This summary is not an extensive overview of all contemplated aspects and is intended to neither identify key or critical elements of all aspects nor delineate the scope of any or all aspects. Its sole purpose is to present some concepts of one or more aspects in a simplified form as a prelude to the more detailed description that is presented later.

This disclosure describes various aspects of stabilizing a temperature of one or more components coupled to a cryostat using a radiative heat source.

In some aspects, a quantum information processing (QIP) system includes a cryostat, a component, and a radiative heat source. The cryostat includes a cryocooler, a housing that defines a cooled volume, and one or more plates disposed within the housing. The component is coupled to the one or more plates and has a coated surface thereon. The radiative heat source is configured to provide thermal radiation to heat the coated surface of the component.

In some aspects, a method for configuring a quantum information processing (QIP) system includes: providing a cryostat comprising a cryocooler and a housing defining a cooled volume; coating a surface of a component to be heated; positioning the component within the cooled volume; and orienting a radiative heat source relative to the cryostat so that the radiative heat source can provide thermal radiation to the coated surface to heat the coated surface.

In some aspects, a system includes a cooled volume, a component positioned in the cold volume, and a thermal radiation source. A surface of the component is coated with a coating comprising one or more of gold, copper, aluminum, silver, a dielectric material, and combinations thereof. The thermal radiation source is positioned outside of the cooled volume and configured provide thermal radiation to the coated surface to heat the coated surface.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Figure 1:
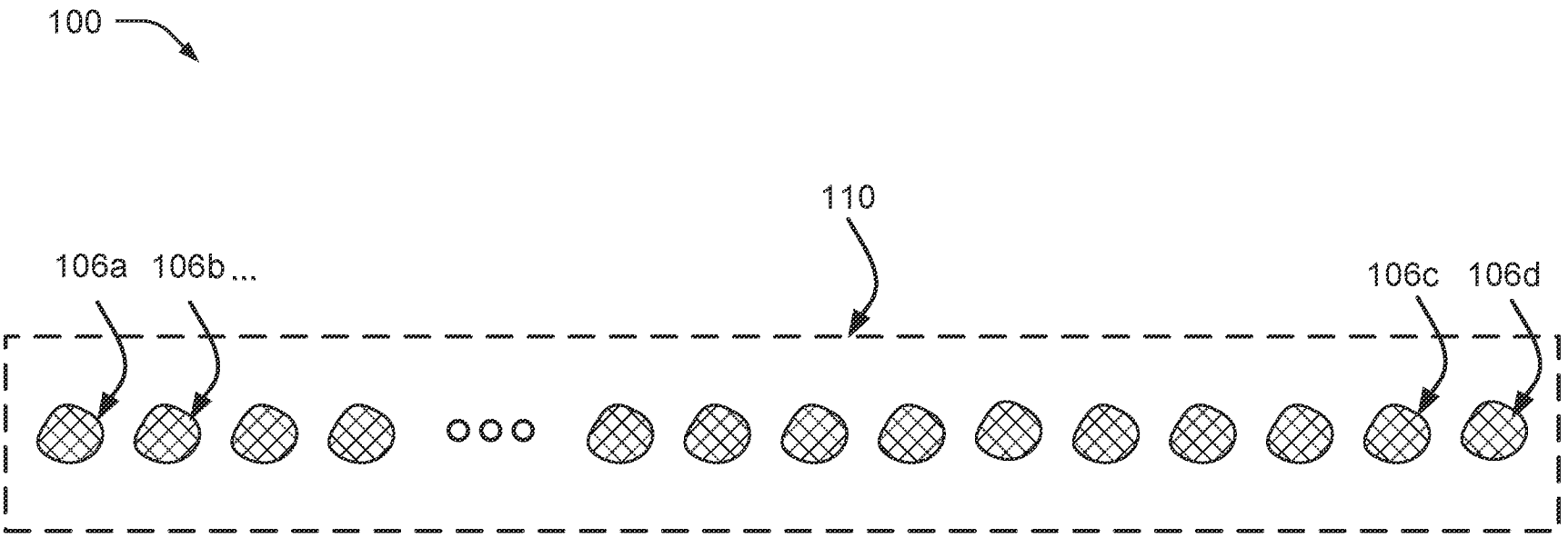
FIG. 1 illustrates a view of atomic ions a linear crystal or chain in accordance with aspects of this disclosure.

The detailed description set forth below in connection with the appended drawings or figures is intended as a description of various configurations or implementations and is not intended to represent the only configurations or implementations in which the concepts described herein may be practiced. The detailed description includes specific details for the purpose of providing a thorough understanding of various concepts. However, it will be apparent to those skilled in the art that these concepts may be practiced without these specific details or with variations of these specific details. In some instances, well known components are shown in block diagram form, while some blocks may be representative of one or more well-known components.

Trapped ion QIP systems are typically operated at cryogenic temperatures to cool atomic ions in a linear crystal or chain in an ion trap to cryogenic temperatures. Operating QIP systems at cryogenic temperatures is advantageous because such temperatures significantly reduce both the density and motional energy of gas molecules inside the ion trap, therefore allowing chains of up to 40 ions to be worked with for several days before the ion chains need to be reloaded. In such systems, quantum gates are typically implemented with tightly focused beams that address individual ions on an ion chain. Detection of qubit states is achieved by collecting photons from ions using high numerical aperture lenses.

In such systems, mechanical structures are typically used to hold optical elements or ion traps into position. Temperature changes in the mechanical structures, which can cause expansion or contraction of the materials forming the mechanical structures, can result in optical misalignment between optical elements in the QIP system and the ion trap. Optical misalignment can cause intensity drift on the addressed qubits, crosstalk errors on neighboring qubits while quantum gates are driven, and/or reduction in photon efficiencies and state detection fidelity. Therefore, it would be advantageous to stabilize mechanical structures within the QIP system by keeping the temperatures of the portions of the QIP system operated at cryogenic temperatures stable.

However, the compressors that generate the cryogenic temperatures in the QIP system cannot be adjusted rapidly, which means that the temperature of the portions of the QIP system operated at cryogenic temperatures may vary. Conventionally, resistive elements (e.g., heaters) may be coupled to mechanical structures within the portions of the QIP system maintained at cryogenic temperatures. An electrical current is applied to the resistive element to maintain a temperature of the mechanical structure. This electrical current may be adjusted more quickly than the compressors, meaning that the heat load provided by the resistive element can be adjusted to maintain the temperature of the mechanical structure. However, this changing electrical current may generate magnetic fields on the trapped ions. The applied electric currents may change the frequencies of the qubits, so the qubits need to be calibrated more frequently The applied electric currents may couple into the trap electrodes and effect trapping potentials, resulting in degradation of system performance. The impact of these electrical currents may be larger in smaller QIP systems, since the system components will be closer together. Further, resistive heaters provide heat to the mechanical structure at the area of contact, which may be relatively small relative to the size of the mechanical structure. In such instances, the heat provided by the resistive heater may be conducted through the mechanical structure unevenly, which can result in internal heat gradients within the mechanical structure.

Solutions to the issues described above are explained in more detail in connection with FIGS. 1-8A, with FIGS. 1-3 providing a background of QIP systems or quantum computers, and more specifically, of atomic-based QIP systems or quantum computers.

Figure 2:
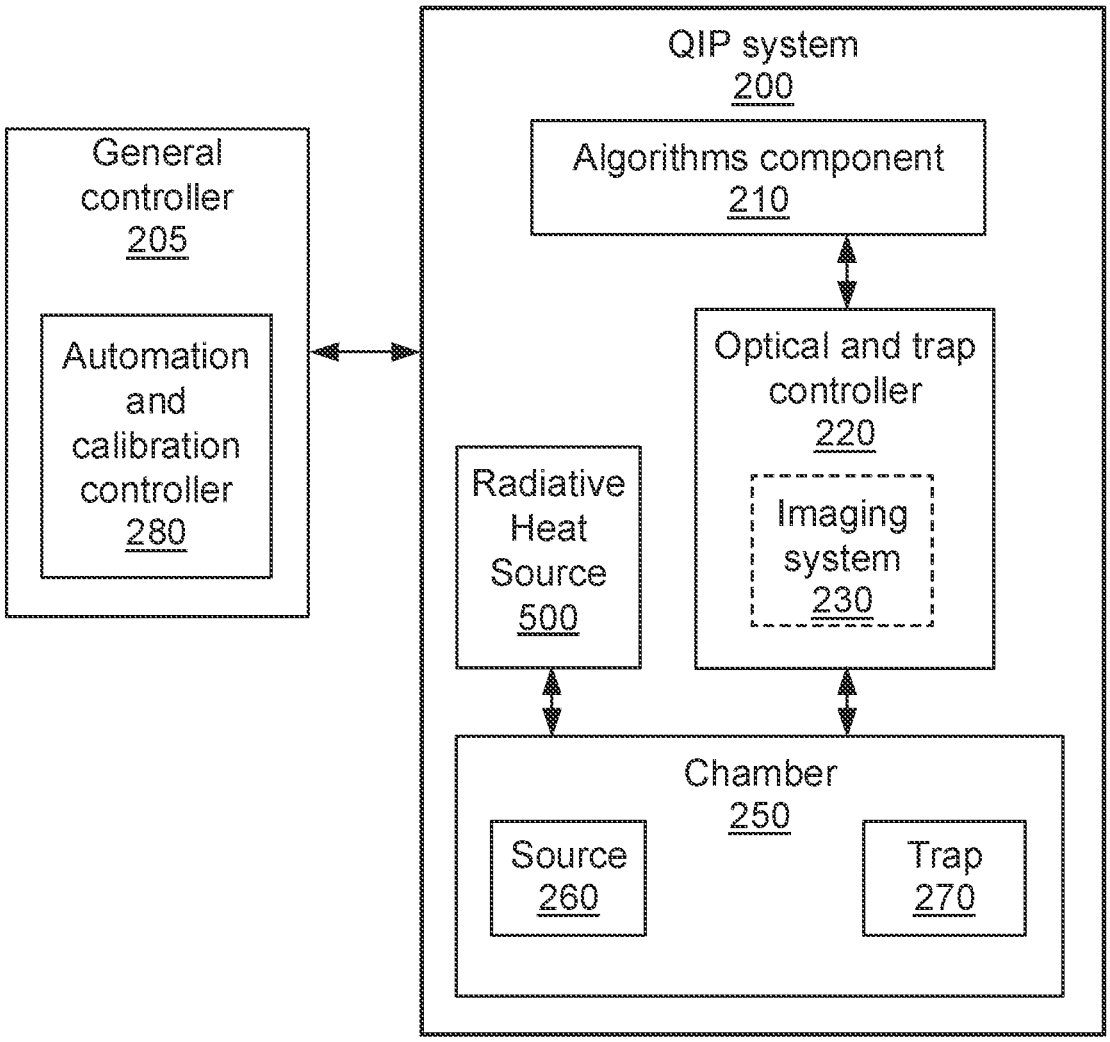
FIG. 2 illustrates an example of a quantum information processing (QIP) system in accordance with aspects of this disclosure.

FIG. 1 illustrates a diagram 100 with multiple atomic ions or ions 106 (e.g., ions 106*a*, 106*b*, . . . , 106*c*, and 106*d*) trapped in a linear crystal or chain 110 using a trap (not shown; the trap can be inside a vacuum chamber as shown in FIG. 2). The trap maybe referred to as an ion trap. The ion trap shown may be built or fabricated on a semiconductor substrate, a dielectric substrate, or a glass die or wafer (also referred to as a glass substrate). The ions 106 may be provided to the trap as atomic species for ionization and confinement into the chain 110. Some or all of the ions 106 may be configured to operate as qubits in a QIP system.

In the example shown in FIG. 1, the trap includes electrodes for trapping or confining multiple ions into the chain 110 laser-cooled to be nearly at rest. The number of ions trapped can be configurable and more or fewer ions may be trapped. The ions can be Ytterbium ions (e.g., $^{171}Yb^{+}$ ions), for example. The ions are illuminated with laser (optical) radiation tuned to a resonance in $^{171}Yb^{+}$ and the fluorescence of the ions is imaged onto a camera or some other type of detection device (e.g., photomultiplier tube or PMT). In this example, ions may be separated by a few microns (μm) from each other, although the separation may vary based on architectural configuration. The separation of the ions is determined by a balance between the external confinement force and Coulomb repulsion and does not need to be uniform. Moreover, in addition to Ytterbium ions, neutral atoms, Rydberg atoms, or other types of atomic-based qubit technologies may also be used. Moreover, ions of the same species, ions of different species, and/or different isotopes of ions may be used. The trap may be a linear RF Paul trap, but other types of confinement devices may also be used, including optical confinements. Thus, a confinement device may be based on different techniques and may hold ions, neutral atoms, or Rydberg atoms, for example, with an ion trap being one example of such a confinement device. The ion trap may be a surface trap, for example.

FIG. 2 illustrates a block diagram that shows an example of a QIP system 200. The QIP system 200 may also be referred to as a quantum computing system, a quantum computer, a computer device, a trapped ion system, or the like. The QIP system 200 may be part of a hybrid computing system in which the QIP system 200 is used to perform quantum computations and operations and the hybrid computing system also includes a classical computer to perform classical computations and operations. The quantum and classical computations and operations may interact in such a hybrid system.

Shown in FIG. 2 is a general controller 205 configured to perform various control operations of the QIP system 200. These control operations may be performed by an operator, may be automated, or a combination of both. Instructions for at least some of the control operations may be stored in memory (not shown) in the general controller 205 and may be updated over time through a communications interface (not shown). Although the general controller 205 is shown separate from the QIP system 200, the general controller 205 may be integrated with or be part of the QIP system 200. The general controller 205 may include an automation and calibration controller 280 configured to perform various calibration, testing, and automation operations associated with the QIP system 200. These calibration, testing, and automation operations may involve, for example, all or part of an algorithms component 210, all or part of an optical and trap controller 220 and/or all or part of a chamber 250.

The QIP system 200 may include the algorithms component 210 mentioned above, which may operate with other parts of the QIP system 200 to perform or implement quantum algorithms, quantum applications, or quantum operations. The algorithms component 210 may be used to perform or implement a stack or sequence of combinations of single qubit operations and/or multi-qubit operations (e.g., two-qubit operations) as well as extended quantum computations. The algorithms component 210 may also include software tools (e.g., compilers) that facility such performance or implementation. As such, the algorithms component 210 may provide, directly or indirectly, instructions to various components of the QIP system 200 (e.g., to the optical and trap controller 220) to enable the performance or implementation of the quantum algorithms, quantum applications, or quantum operations. The algorithms component 210 may receive information resulting from the performance or implementation of the quantum algorithms, quantum applications, or quantum operations and may process the information and/or transfer the information to another component of the QIP system 200 or to another device (e.g., an external device connected to the QIP system 200) for further processing.

The QIP system 200 may include the optical and trap controller 220 mentioned above, which controls various aspects of a trap 270 in the chamber 250, including the generation of signals to control the trap 270. The optical and trap controller 220 may also control the operation of lasers, optical systems, and optical components that are used to provide the optical beams that interact with the atoms or ions in the trap. Optical systems that include multiple components may be referred to as optical assemblies. The optical beams are used to set up the ions, to perform or implement quantum algorithms, quantum applications, or quantum operations with the ions, and to read results from the ions. Control of the operations of laser, optical systems, and optical components may include dynamically changing operational parameters and/or configurations, including controlling positioning using motorized mounts or holders. When used to confine or trap ions, the trap 270 may be referred to as an ion trap. The trap 270, however, may also be used to trap neutral atoms, Rydberg atoms, and other types of atomic-based qubits. The lasers, optical systems, and optical components can be at least partially located in the optical and trap controller 220, an imaging system 230, and/or in the chamber 250.

The QIP system 200 may include the imaging system 230. The imaging system 230 may include a high-resolution imager (e.g., CCD camera) or other type of detection device (e.g., PMT) for monitoring the ions while they are being provided to the trap 270 and/or after they have been provided to the trap 270 (e.g., to read results). In an aspect, the imaging system 230 can be implemented separate from the optical and trap controller 220, however, the use of fluorescence to detect, identify, and label ions using image processing algorithms may need to be coordinated with the optical and trap controller 220.

In addition to the components described above, the QIP system 200 can include a source 260 that provides atomic species (e.g., a plume or flux of neutral atoms) to the chamber 250 having the trap 270. When atomic ions are the basis of the quantum operations, that trap 270 confines the atomic species once ionized (e.g., photoionized). The trap 270 may be part of what may be referred to as a processor or processing portion of the QIP system 200. That is, the trap 270 may be considered at the core of the processing operations of the QIP system 200 since it holds the atomic-based qubits that are used to perform or implement the quantum operations or simulations. At least a portion of the source 260 may be implemented separate from the chamber 250.

It is to be understood that the various components of the QIP system 200 described in FIG. 2 are described at a high-level for ease of understanding. Such components may include one or more sub-components, the details of which may be provided below as needed to better understand certain aspects of this disclosure.

Aspects of this disclosure may be implemented at least partially using the general controller 205, a radiative heat source, mechanical structures used to position the imaging system 230, mechanical structures used to position the trap 270, mechanical structures used to position optical systems and components of the QIP system 200, and so forth.

Figure 3:
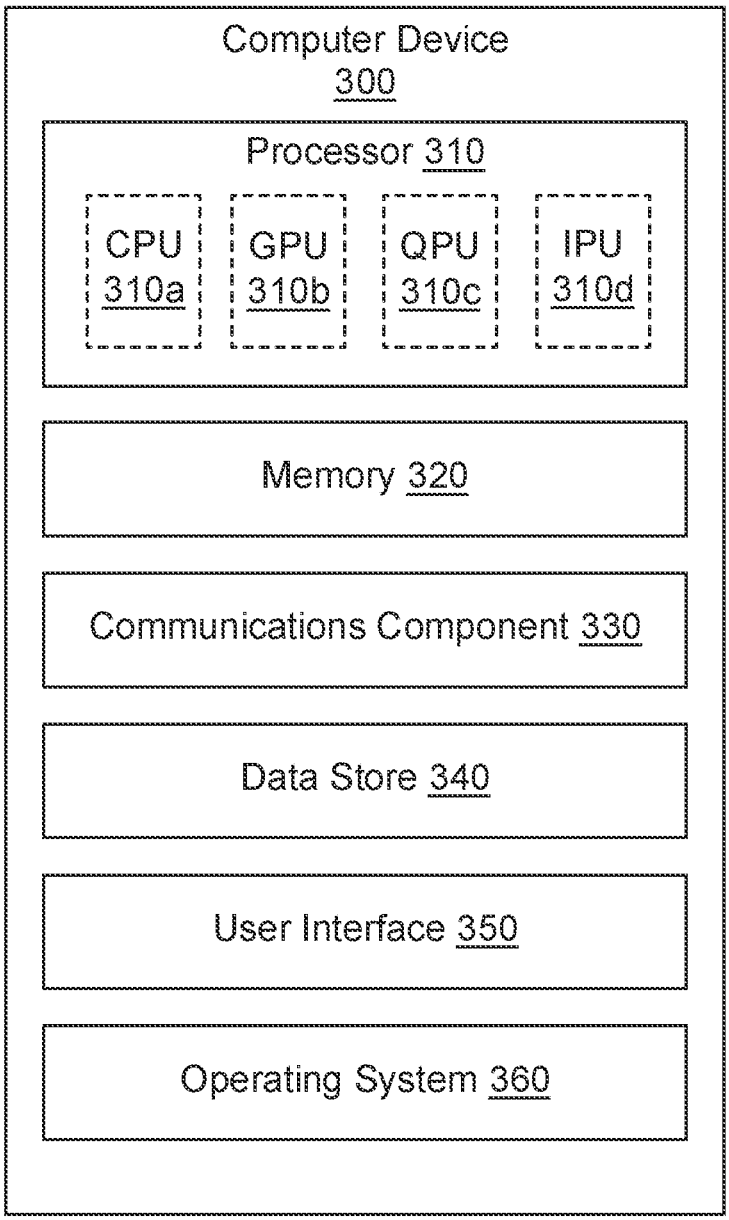
FIG. 3 illustrates an example of a computer device in accordance with aspects of this disclosure.

Referring now to FIG. 3, an example of a computer system or device 300 is shown. The computer device 300 may represent a single computing device, multiple computing devices, or a distributed computing system, for example. The computer device 300 may be configured as a quantum computer (e.g., a QIP system), a classical computer, or to perform a combination of quantum and classical computing functions, sometimes referred to as hybrid functions or operations. For example, the computer device 300 may be used to process information using quantum algorithms, classical computer data processing operations, or a combination of both. In some instances, results from one set of operations (e.g., quantum algorithms) are shared with another set of operations (e.g., classical computer data processing). A generic example of the computer device 300 implemented as a QIP system capable of performing quantum computations and simulations is, for example, the QIP system 200 shown in FIG. 2.

The computer device 300 may include a processor 310 for carrying out processing functions associated with one or more of the features described herein. The processor 310 may include a single processor, multiple set of processors, or one or more multi-core processors. Moreover, the processor 310 may be implemented as an integrated processing system and/or a distributed processing system. The processor 310 may include one or more central processing units (CPUs) 310*a*, one or more graphics processing units (GPUs) 310*b*, one or more quantum processing units (QPUs) 310*c*, one or more intelligence processing units (IPUs) 310*d* (e.g., artificial intelligence or AI processors), or a combination of some or all those types of processors. In one aspect, the processor 310 may refer to a general processor of the computer device 300, which may also include additional processors 310 to perform more specific functions (e.g., including functions to control the operation of the computer device 300). Quantum operations may be performed by the QPUs 310*c*. Some or all of the QPUs 310*c* may use atomic-based qubits, however, it is possible that different QPUs are based on different qubit technologies.

The computer device 300 may include a memory 320 for storing instructions executable by the processor 310 to carry out operations. The memory 320 may also store data for processing by the processor 310 and/or data resulting from processing by the processor 310. In an implementation, for example, the memory 320 may correspond to a computer-readable storage medium that stores code or instructions to perform one or more functions or operations. Just like the processor 310, the memory 320 may refer to a general memory of the computer device 300, which may also include additional memories 320 to store instructions and/or data for more specific functions.

It is to be understood that the processor 310 and the memory 320 may be used in connection with different operations including but not limited to computations, calculations, simulations, controls, calibrations, system management, and other operations of the computer device 300, including any methods or processes described herein.

Further, the computer device 300 may include a communications component 330 that provides for establishing and maintaining communications with one or more parties utilizing hardware, software, and services. The communications component 330 may also be used to carry communications between components on the computer device 300, as well as between the computer device 300 and external devices, such as devices located across a communications network and/or devices serially or locally connected to computer device 300. For example, the communications component 330 may include one or more buses, and may further include transmit chain components and receive chain components associated with a transmitter and receiver, respectively, operable for interfacing with external devices. The communications component 330 may be used to receive updated information for the operation or functionality of the computer device 300.

Additionally, the computer device 300 may include a data store 340, which can be any suitable combination of hardware and/or software, which provides for mass storage of information, databases, and programs employed in connection with the operation of the computer device 300 and/or any methods or processes described herein. For example, the data store 340 may be a data repository for operating system 360 (e.g., classical OS, or quantum OS, or both). In one implementation, the data store 340 may include the memory 320. In an implementation, the processor 310 may execute the operating system 360 and/or applications or programs, and the memory 320 or the data store 340 may store them.

The computer device 300 may also include a user interface component 350 configured to receive inputs from a user of the computer device 300 and further configured to generate outputs for presentation to the user or to provide to a different system (directly or indirectly). The user interface component 350 may include one or more input devices, including but not limited to a keyboard, a number pad, a mouse, a touch-sensitive display, a digitizer, a navigation key, a function key, a microphone, a voice recognition component, any other mechanism capable of receiving an input from a user, or any combination thereof. Further, the user interface component 350 may include one or more output devices, including but not limited to a display, a speaker, a haptic feedback mechanism, a printer, any other mechanism capable of presenting an output to a user, or any combination thereof. In an implementation, the user interface component 350 may transmit and/or receive messages corresponding to the operation of the operating system 360. When the computer device 300 is implemented as part of a cloud-based infrastructure solution, the user interface component 350 may be used to allow a user of the cloud-based infrastructure solution to remotely interact with the computer device 300.

In connection with the systems described in FIGS. 1-3, a cryostat 400 and a radiative heat source 500 are coupled to the QIP system 200. Although the present example is described with respect to one radiative heat source 500, it is contemplated that more than one radiative heat sources 500 could be used in alternative aspects.

Figure 4:
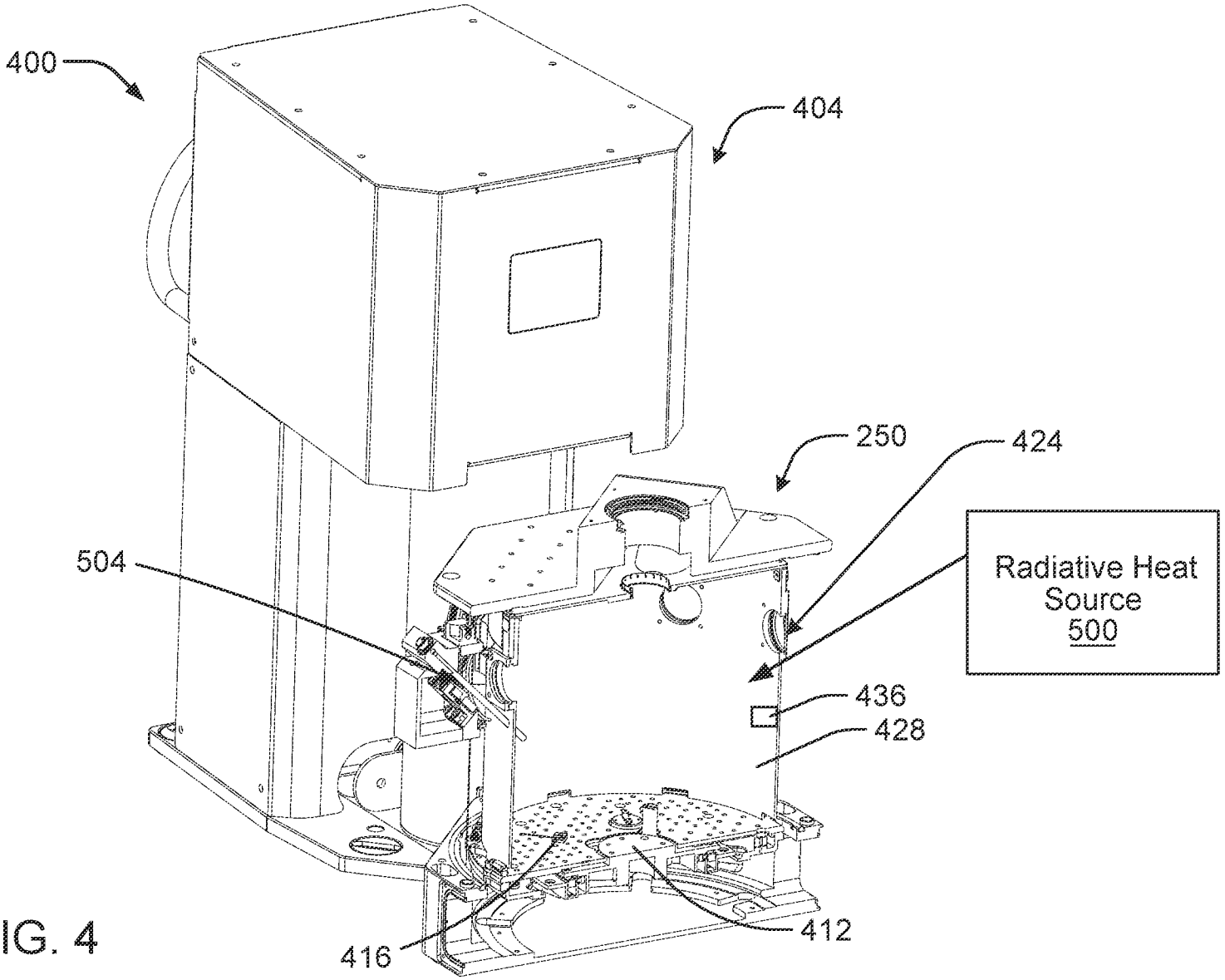
FIG. 4 illustrates a perspective view of an example cryostat and the radiative heat source of the QIP system in accordance with aspects of this disclosure.

FIG. 4 illustrates a perspective view of the cryostat 400 and the radiative heat source 500 of the QIP system 200. The cryostat 400 includes a cryocooler 404 (including one or more compressors, not shown), a thermal connection (not shown), a first plate 412, a second plate 416, and a housing such as the chamber 250, which defines a volume to be cooled. The chamber 250 includes a plurality of apertures 424 through which optical components, such as lasers, may be directed. The thermal connection is coupled between the cryocooler 404 and the first and second plates 412, 416 to cool the first and second plates 412, 416. In some aspects, the first plate 412 may be cooled to approximately 4 Kelvin (K). In some aspects, the second plate 416 may be cooled to approximately 100 K. Components may be mounted to the first and second plates 412, 416 to cool the components via conductive heat transfer. The first and second plates 412, 416, and components coupled thereto, are positioned within the chamber 250. Since these components are cooled by conductive heat transfer with the plates 412, 416, the heat of these components may vary based on fluctuations in activity of the compressor. In the present disclosure, such components are configured to be radiatively heated to stabilize the temperatures of these components despite these fluctuations in the activity of the compressor. Such components are interchangeably referred to herein as "components to be heated." An example component to be heated includes a radiation shield 428 may be positioned around a perimeter of the second plate 416. The radiation shield 428 is configured to prevent black body radiation from thermally heating the first plate 412 and components coupled thereto.

Figure 5:
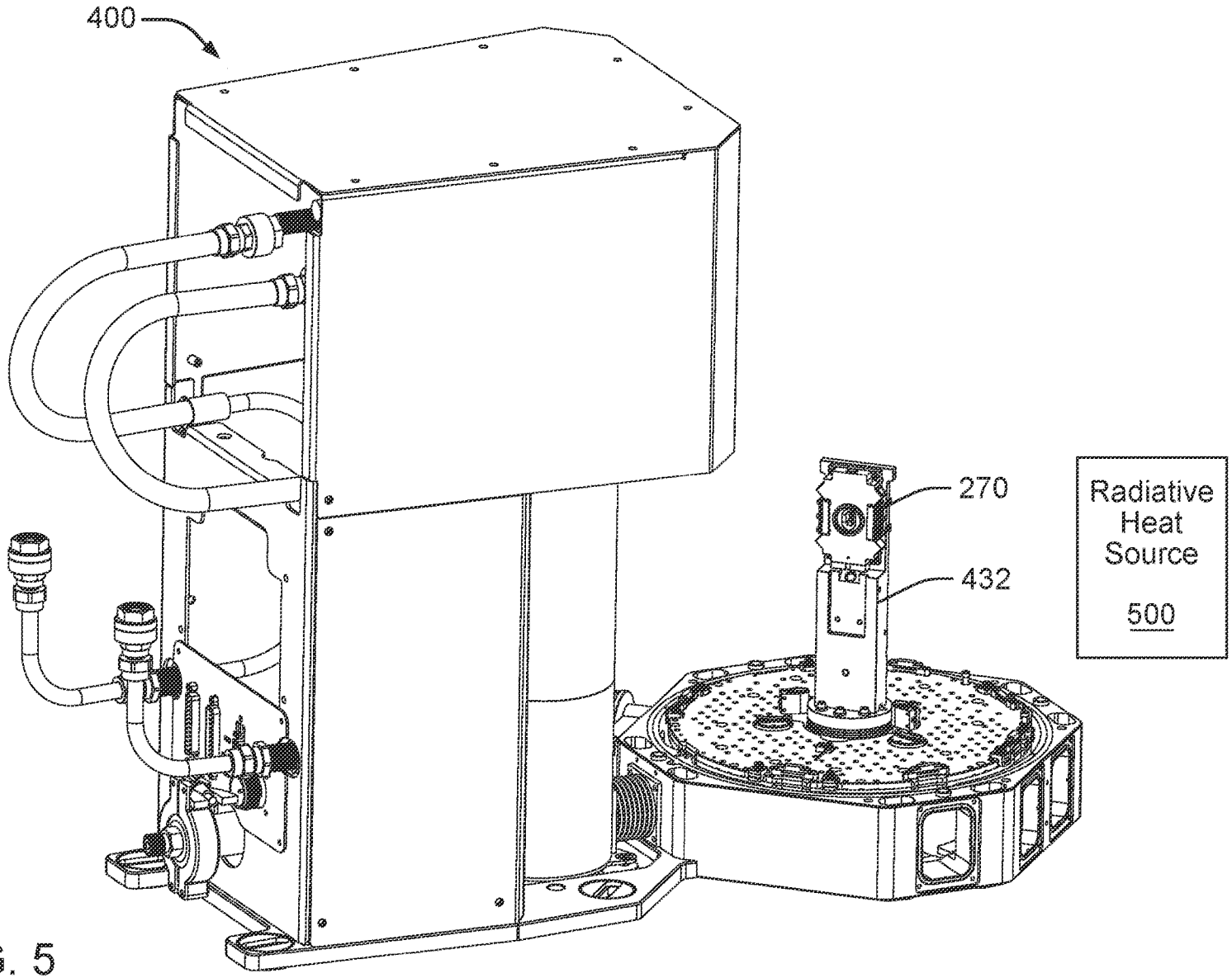
FIG. 5 illustrates another perspective view of an example cryostat and the radiative heat source of the QIP system in accordance with aspects of this disclosure.

FIG. 5 illustrates other example components to be heated. FIG. 5 illustrates the cryostat 400 with the chamber 250 and the radiation shield 428 removed. A cold finger 432 is coupled to the first plate 412. The ion trap 270 is coupled to the cold finger 432. Both the cold finger 432 and the ion trap 270 are components that can be heated by the radiative heat source 500. Other components that may be heated include optical components, mechanical support structures for optical components, circuit boards, and/or electrical components such as radiofrequency (RF) filters, RF samplers, RF rectifiers, and so forth.

The radiative heat source 500 is configured to produce thermal radiation having predefined wavelengths. The radiative heat source 500 may be or include a laser 504 or a light emitting diode (LED). The thermal radiation may be produced as light fields (e.g., by the laser 504 or the LED) in exemplary aspects.

In some aspects, such as the exemplary embodiment illustrated in FIG. 4, the radiative heat source 500 includes one or more lasers 504. In such aspects, the radiative heat source 500 is oriented relative to the chamber 250, such that the laser 504 is configured to provide thermal radiation to a particular component within the chamber 250 (e.g., through one of the apertures 424). In contrast to resistive heating, radiative heat can be provided to a broad or large area of the particular component, which maintains the component at a more uniform temperature. For example, the radiative heat may generally be applied to the entire component in an exemplary aspect. As a result, the radiative heat source 500 including the laser 504 can directly heat the component to be heated without being coupled to the component to be heated with wires, cables, heating elements, and so forth. Further, the laser 504 can be configured to be precisely directed onto the surfaces to be heated from outside the chamber 250, which is beneficial in smaller cryostats. Further, the laser 504 can be configured to illuminate a larger area of contact than a conventional element such as a resistive heater, which can reduce and/or prevent the occurrence of thermal gradients within the component to be heated.

In some aspects, the radiative heat source 500 may be coupled to fiber optic cables (not shown). In such aspects, the radiative heat source 500 may include one or more LEDs coupled into fiber optic wires. In such aspects, the fiber optic wires are oriented within the chamber 250 to deliver thermal radiation to a particular component or particular components to be heated.

In some aspects, the component to be heated may be or include the radiation shield 428 coupled to the second plate 416. In some aspects, the component may be or include a mechanical support structure for optical components placed inside the cryostat 400. In some aspects, the component may be or include a component mounted to the first plate 412, such as the cold finger 432 or the ion trap 270. In some aspects, the component may be or include one or more circuit boards or electrical components such as RF filters, RF samplers, RF rectifiers, and so forth. One or more temperature sensors 436 may be coupled to each component to be heated, as shown for example in FIG. 4. These temperature sensors 436 are configured to determine a temperature of the component to be heated and transmit information indicative of the temperature of the component to be heated to a controller of the QIP system 200, such as the general controller 205.

Figure 6:
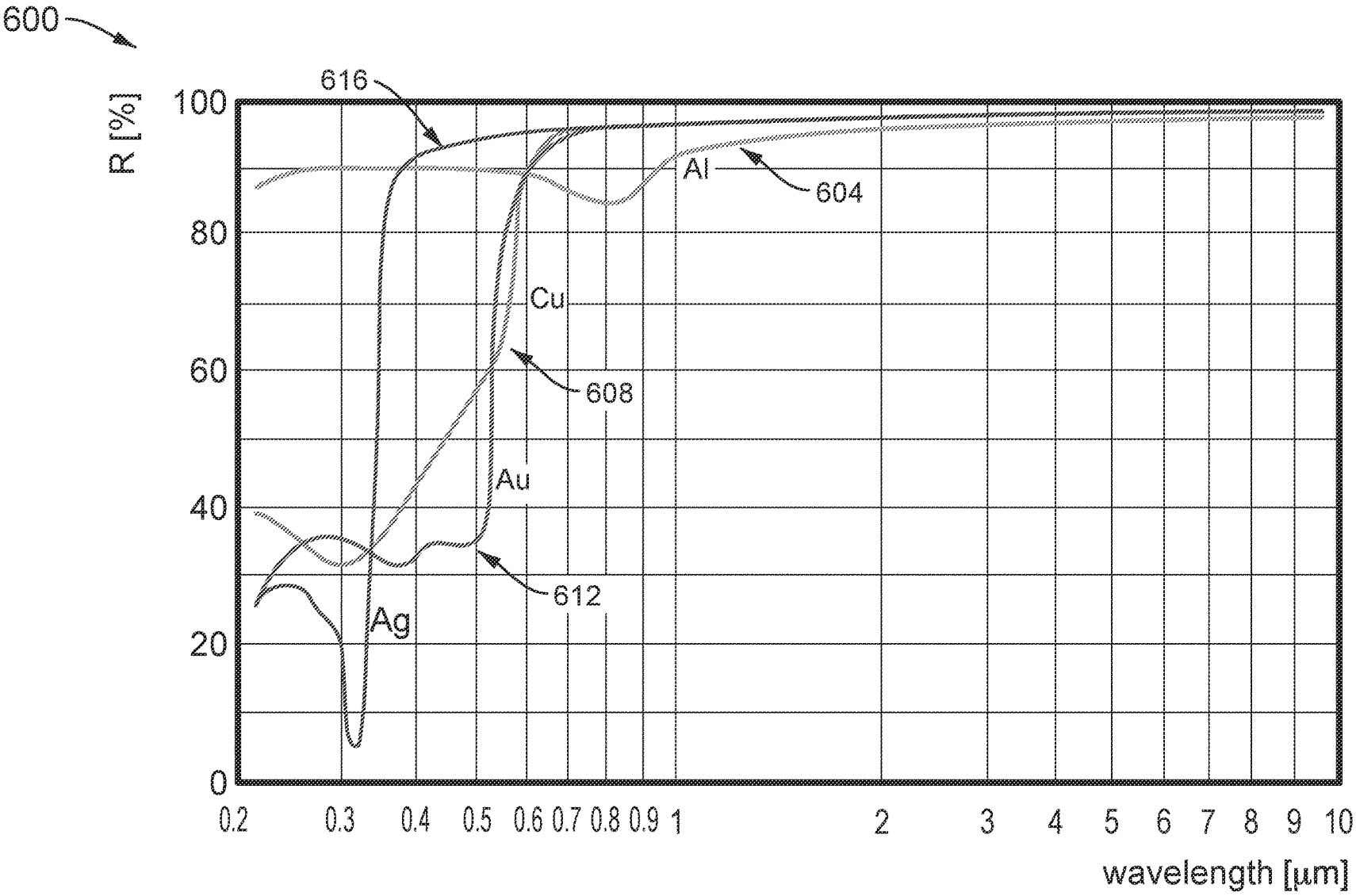
FIG. 6 illustrates a plot of percent reflection (e.g., of incoming thermal radiation) at various wavelengths for several example coating materials in accordance with aspects of this disclosure.

In some aspects, the component to be heated may be coated with a coating material that is configured to absorb a particular wavelength or range of wavelengths of radiation. The coatings used are typically shiny or reflective in order to reduce blackbody absorption of the coated surfaces. Example coatings may be or include gold, silver, copper, or aluminum. FIG. 6 illustrates a plot 600 of percent reflection (e.g., of incoming thermal radiation) at various wavelengths for several example coating materials. The percentage of incoming thermal radiation that is not reflected is absorbed by the coating material. Line 604 shows the reflectivity of aluminum, which shows absorption (indicated by the reduced reflectivity) at substantially 800 nm. Line 608 shows the reflectivity of copper, which shows absorption (indicated by the reduced reflectivity) below 600 nm. Line 612 shows the reflectivity of gold, which shows absorption (indicated by the reduced reflectivity) below substantially 500 nm. Line 616 shows the reflectivity of silver, which shows absorption (indicated by the reduced reflectivity) at substantially 300 nm. In some aspects, dielectric coatings can be applied to metallic surfaces to reduce reflectivity at select wavelengths.

The radiative heat source 500 is communicatively coupled (e.g., via a wireless or wired connection) to a controller of the QIP system 200, such as the general controller 205. The radiative heat source 500 is configured to produce thermal radiation a wavelength or range of wavelengths that can be absorbed by the particular coating material(s) applied to the component(s) to be heated. In some aspects, the radiative heat source 500 may be configured to produce thermal radiation having wavelengths less than or equal to substantially 800 nanometers (nm). As used herein, in the context of a number, the word "substantially" takes into account possible differences that may result for variances in manufacturing, for example. In an example aspect, "substantially" may be considered to be within 10% of the number. In some aspects, the radiative heat source 500 may be configured to produce thermal radiation at substantially 800 nm. In some aspects, the radiative heat source 500 may be configured to produce thermal radiation having wavelengths less than or equal to substantially 600 nm. In some aspects, the thermal radiation may have wavelengths less than or equal to substantially 500 nm. The wavelengths typically used to excite the trapped ions are typically substantially 367 nm or substantially 935 nm for ytterbium ions. The wavelengths typically used to excite trapped ions are substantially 493 nm, substantially 614 nm, or substantially 650 nm for barium ions. Coatings configured to absorb thermal radiation at wavelengths far away from the wavelengths used to excite the trapped ions to prevent the radiative heat wavelengths produced by the radiative heat source 500 from disrupting operation of the QIP system 200.

In some aspects, the wavelength of thermal radiation produced by the radiative heat source 500 may be determined based on the coating material. For example, thermal radiation having a wavelength of substantially 800 nm may be used when the component to be heated has an aluminum coating. For example, thermal radiation having a wavelength less than or equal to substantially 600 nm may be used when the component to be heated has a copper coating. For example, thermal radiation having a wavelength less than or equal to substantially 500 nm may be used when the component to be heated has an gold coating. For example, thermal radiation having a wavelength of substantially 300 nm may be used when the component to be heated has a silver coating.

The general controller 205 (or another controller of the QIP system 200) is configured to control operation of the one or more radiative heat sources 500 to stabilize the temperature of the one or more components to be heated to a target temperature and/or to a target temperature range. For example, for components to be heated that are coupled to the second plate 416, the target temperature may be substantially 100 K and/or the target temperature range may be between substantially 30 K and substantially 150 K in an exemplary aspect. In another example, for components to be heated that are coupled to the first plate 412, the target temperature may be 4 K and/or the target temperature range may be between substantially 3 K and substantially 10 K. In some aspects, the general controller 205 can be configured to determine the target temperature and/or the target temperature range for components to be heated coupled first plate 412 or the second plate 416. In an exemplary aspect, the general controller 205 can be configured to determine the target temperature and/or target temperature range based on the effectiveness of the thermal connectiveness between the components to be heated and the plate the component to be heated is coupled to, the heat load on the plate the component to be heated is coupled to, and so forth. In some aspects, general controller 205 may be configured to allow the temperature of the plates 412, 416 may be allowed to settle for a predefined time period. The general controller may then be configured to stabilize the temperature at a second temperature that is warmer than the settled temperature.

Figure 7:
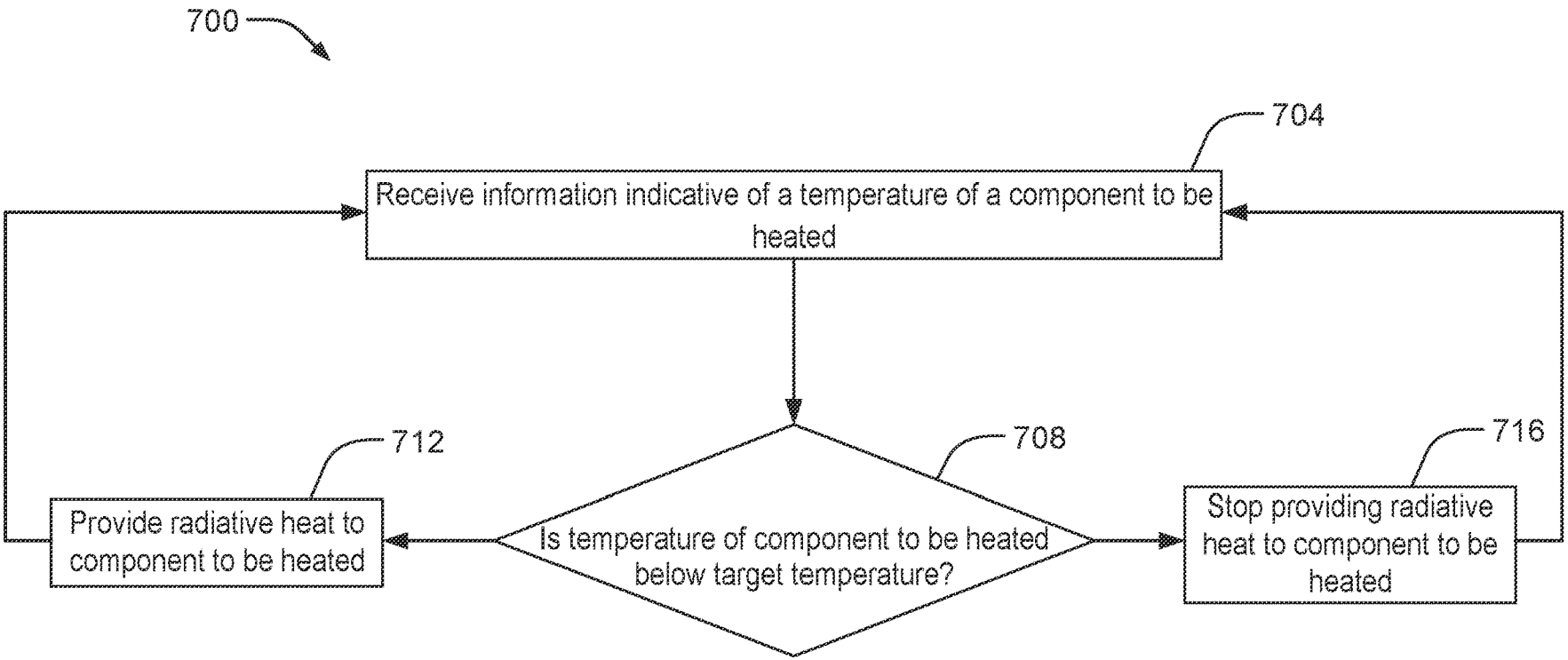
FIG. 7 illustrates a flowchart of an example process for stabilizing the temperature of an example component to be heated in accordance with aspects of this disclosure.

FIG. 7 illustrates a flowchart of an example process 700 for stabilizing the temperature of an example component to be heated. Although the process 700 is described with respect to one radiative heat source 500 and one component to be heated, it is contemplated that the process 700 could also be used with more than one radiative heat source 500 and/or more than one component to be heated. The general controller 205 is configured to receive information indicative of the temperature of the component to be heated from the temperature sensor 436, as shown at block 704. The general controller 205 is configured to compare the information indicative of the component to be heated to the target temperature, as shown at block 708. In response to determining that the temperature of the component to be heated is below the target temperature, the general controller 205 commands the radiative heat source 500 to provide radiative heat to the component to be heated. In response to determining that the temperature of the component to be heated is at or above the target temperature, the general controller 205 commands the radiative heat source 500 to stop providing radiative heat to the component to be heated.

Figure 8A:
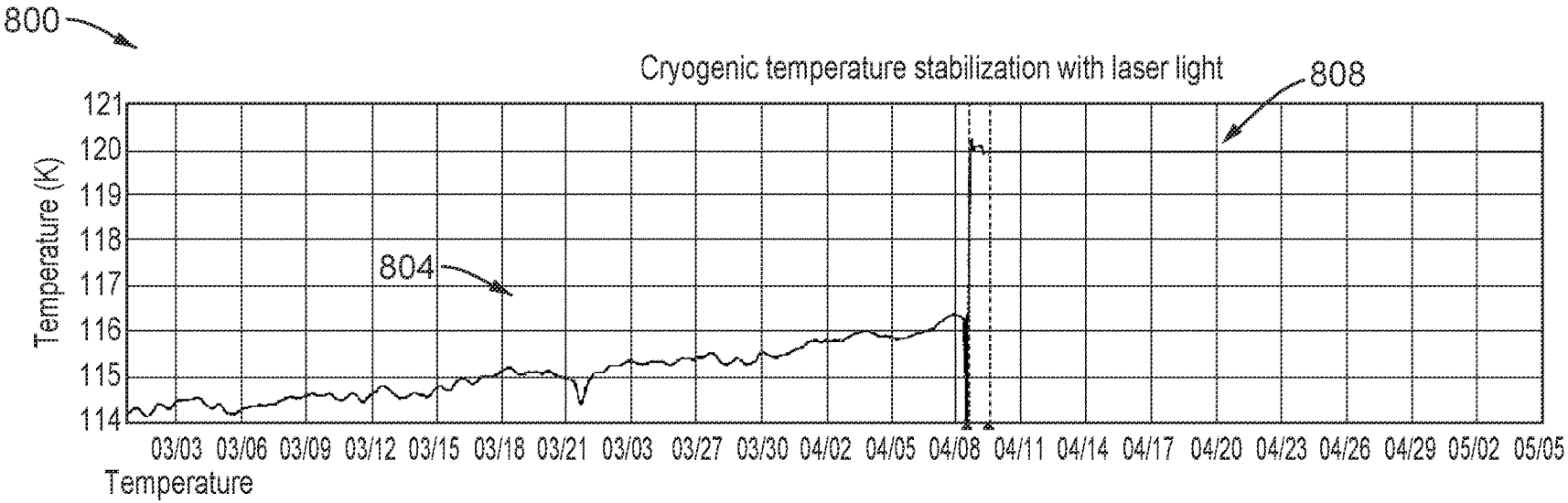
FIG. 8A illustrates an example plot of temperature versus time for the temperature of a component of the cryostat in accordance with aspects of this disclosure.
Figure 8B:
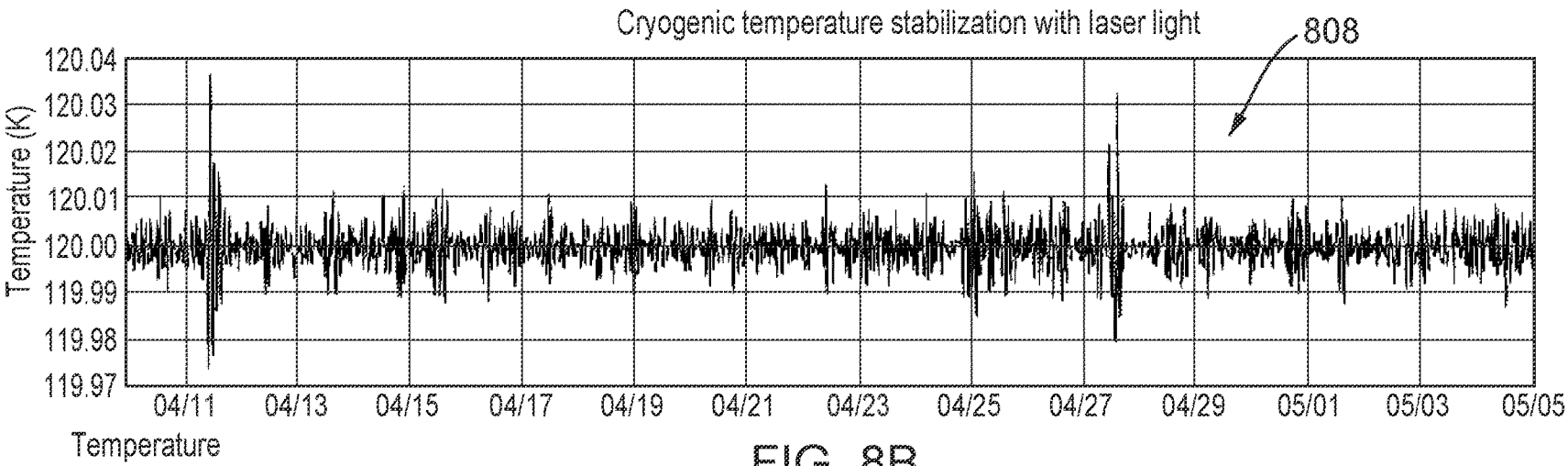
FIG. 8B illustrates an enlarged portion of the plot of FIG. 8A.

FIG. 8A illustrates a plot 800 of temperature versus time for the temperature of the radiation shield 248 surrounding the second plate 416. During the period from March 1 through April 8, indicated by arrow 804, the temperature of the radiation shield 240 rises over time. For example, the temperature of the radiation shield at March 1 is approximately 114 K and the temperature at April 8 is approximately 116 K, indicating that without heating the radiation shield 248, the temperature of the radiation shield 247 gradually rises over time. During the period from April 9 to May 5, indicated by arrow 808, the temperature of the radiation shield 248 was stabilized as described with respect to FIG. 7. As shown in the plot 800, the temperature of the radiation shield is substantially stable at 120 K during the period from April 9 to May 5. FIG. 8B is an enlargement of the portion of the plot 800 indicated by the arrow 808. As shown in FIG. 8B, the temperature of the radiation shield 240 is stable to within approximately 10 millikelvin (mK) of the target temperature during most of the time period from April 9 to May 5. Based on the plot 800, it is apparent that heat stabilization using thermal radiation is effective for weeks.

Figure 9:
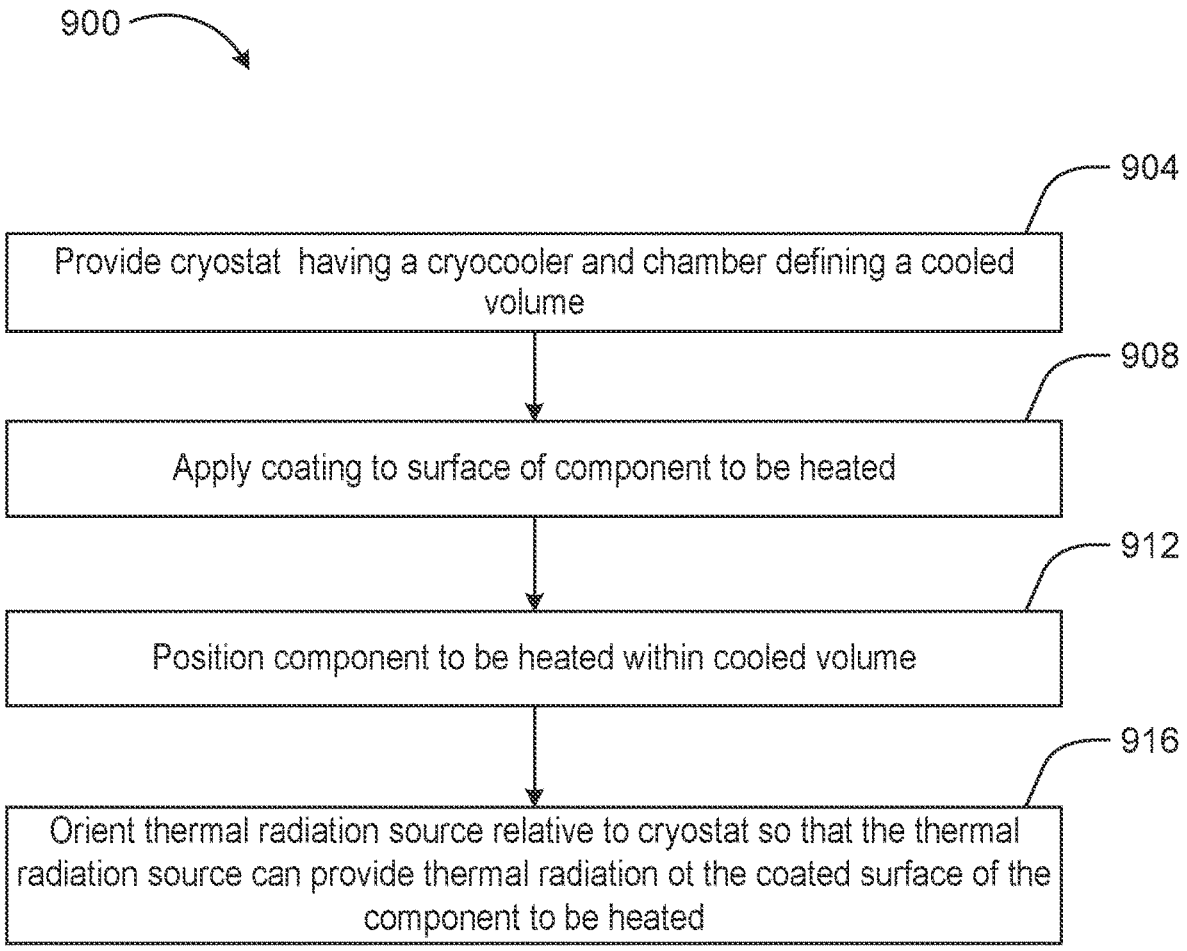
FIG. 9 illustrates a flowchart of an example method for configuring a QIP system in accordance with aspects of this disclosure.

FIG. 9 illustrates a flowchart 900 of an example method for configuring a QIP system. In some aspects, a method of manufacturing and/or configuring a quantum information processing (QIP) system may include providing the cryostat 400 having a cryocooler and the chamber 250, defining a cooled volume, as shown at block 904. The method may include applying a coating (for example by sputtering or chemical deposition) to a surface of a component to be heated, as shown at block 908. Example coatings include gold, silver, copper, aluminum, and/or dielectric materials. In some aspects, the method includes positioning the component to be heated within the cooled volume, as shown at block 912. In some aspects, the method includes orienting the radiative heat source 500 relative to the cryostat 400 so that the radiative heat source 500 can provide thermal radiation to the coated surface of the component to be heated to heat the coated surface of the component to be heated, as shown at block 916. In some aspects, the radiation source may be configured to provide the thermal radiation as light fields. In aspects in which the radiative heat source 500 includes one or more lasers, block 916 may include orienting the radiative heat source 500 relative to the chamber 250, such that the laser 504 can provide thermal radiation to a particular component to be heated within the chamber 250 (e.g., through one of the apertures 424). In aspects in which the radiative heat source includes one or more LEDs, block 916 may include orienting one or more fiber optic wires to direct light produced by the one or more LEDs to provide thermal radiation to a particular component to be heated within the chamber 250.

The previous description of the disclosure is provided to enable a person skilled in the art to make or use the disclosure. Various modifications to the disclosure will be readily apparent to those skilled in the art, and the common principles defined herein may be applied to other variations without departing from the scope of the disclosure. Furthermore, although elements of the described aspects may be described or claimed in the singular, the plural is contemplated unless limitation to the singular is explicitly stated. Additionally, all or a portion of any aspect may be utilized with all or a portion of any other aspect, unless stated otherwise. Thus, the disclosure is not to be limited to the examples and designs described herein but is to be accorded the widest scope consistent with the principles and novel features disclosed herein.

What is claimed is:

1. A quantum information processing (QIP) system comprising:

a cryostat comprising a cryocooler, a housing that defines a cooled volume, and one or more plates coupled to the cryocooler, wherein the one or more plates are disposed within the housing;

a component having a coated surface thereon and coupled to the one or more plates, such that the component is configured to be cooled by the one or more plates; and a radiative heat source configured to provide thermal radiation to heat the coated surface of the component.

2. The QIP system of claim 1, wherein the coated surface includes gold, copper, aluminum, silver, a dielectric material and combinations thereof.

3. The QIP system of claim 1, wherein the radiative heat source is configured to provide thermal radiation having a wavelength substantially 800 nanometers or lower.

4. The QIP system of claim 1, wherein the radiative heat source is configured to provide thermal radiation to the coated surface through one or more openings in the housing.

5. The QIP system of claim 1, wherein the radiative heat source includes a laser or a light emitting diode (LED).

6. The QIP system of claim 1, wherein the coated surface includes a surface of a cold finger.

7. The QIP system of claim 1, wherein the coated surface includes one or more of a surface of a radiation shield, an ion trap, a cold finger, an optical component, a mechanical support structure for an optical component, a circuit board, an electrical component, and combinations thereof.

8. The QIP system of claim 1, further comprising:

a temperature sensor configured to provide information indicative of a temperature of the component; and a controller configured to control the radiative heat source to maintain, based on the information provided by the temperature sensor, the temperature of the component within a predefined threshold.

9. The QIP system of claim 8, wherein the predefined threshold is 30 K to 150 K.

10. The QIP system of claim 8, wherein the predefined threshold is 3 K to 10 K.

11. The QIP system of claim 1, wherein the thermal radiation includes a light field.

12. The QIP system of claim 1, wherein the radiative heat source is configured to directly heat the coated surface.

13. The QIP system of claim 1, wherein the radiative heat source is configured to reduce the occurrence of thermal gradients within the component to be heated relative to thermal gradients that occur when the component to be heated is heated with a resistive heater.

14. A method for configuring a quantum information processing (QIP) system comprising:

providing a cryostat comprising a cryocooler a housing defining a cooled volume, and one or more plates coupled to the cryocooler, wherein the one or more plates are disposed within the housing;

coating a surface of a component to be heated;

positioning the component within the cooled volume;

coupling the component to the one or more plates configured to cool the component; and orienting a radiative heat source relative to the cryostat so that the radiative heat source can provide thermal radiation to the coated surface to heat the coated surface.

15. The method of claim 14, wherein the coating includes gold, copper, aluminum, silver, a dielectric, and combinations thereof.

16. The method of claim 14, wherein the radiative heat source heats the component to be heated more uniformly than a resistive heater.

17. The method of claim 14, wherein the radiative heat source is outside of the housing of the cryostat.

18. A system comprising:

a cooled volume;

a component positioned in the cooled volume, wherein a surface of the component is coated with a coating comprising one or more of gold, copper, aluminum, silver, a dielectric material, and combinations thereof;

a thermal radiation source positioned outside of the cooled volume and configured to provide thermal radiation to the coated surface to heat the coated surface;

a temperature sensor configured to provide information indicative of a temperature of the component; and a controller configured to control the radiative heat source to maintain, based on the information provided by the temperature sensor, the temperature of the component within a predefined threshold.

19. The system of claim 18, wherein the thermal radiation source is configured to provide thermal radiation having a wavelength substantially 800 nanometers or lower.

20. The QIP system of claim 18, wherein the coated surface includes one or more of a surface of a radiation shield, an ion trap, a cold finger, an optical component, a mechanical support structure for an optical component, a circuit board, an electrical component, and combinations thereof.

* * * * *